US006553691B2

(12) United States Patent
Huang

(10) Patent No.: US 6,553,691 B2
(45) Date of Patent: Apr. 29, 2003

(54) SELF-INFLATABLE AIR CUSHION FOR SHOES

(76) Inventor: Ing-Chung Huang, No. 218 Cheng Kung Three Road, Nantou City (TW)

( * ) Notice: Subject to any disclaimer, the term of this patent is extended or adjusted under 35 U.S.C. 154(b) by 38 days.

(21) Appl. No.: 09/915,282

(22) Filed: Jul. 27, 2001

(65) Prior Publication Data

US 2001/0045026 A1 Nov. 29, 2001

Related U.S. Application Data

(63) Continuation-in-part of application No. 09/388,540, filed on Sep. 2, 1999, now abandoned.

(51) Int. Cl.[7] ..... A43B 13/20; A47C 27/08

(52) U.S. Cl. ..... 36/29; 36/35 B; 5/655.3; 5/654; 5/708

(58) Field of Search ..... 36/29, 35 B, 153, 36/88, 93; 5/655.3, 654, 655.5, 708

(56) References Cited

U.S. PATENT DOCUMENTS 4,446,634 A * 5/1984 Johnson et al. ..... 36/29
4,991,317 A * 2/1991 Lakic ..... 36/29
5,025,575 A * 6/1991 Lakic ..... 36/29
5,335,382 A * 8/1994 Huang ..... 36/29
5,353,525 A * 10/1994 Grim ..... 36/29
5,406,661 A * 4/1995 Pekar ..... 36/29
5,558,395 A * 9/1996 Huang ..... 36/29
5,794,361 A * 8/1998 Sadler ..... 36/29
5,937,462 A * 8/1999 Huang ..... 36/29
6,014,823 A * 1/2000 Lakic ..... 36/29

FOREIGN PATENT DOCUMENTS

WO 98/57560 * 12/1998

* cited by examiner

*Primary Examiner*—Ted Kavanaugh
(74) *Attorney, Agent, or Firm*—Bacon & Thomas, PLLC

(57) ABSTRACT

Support is provided to the foot of a shoe wearer by an air cushion that includes a support chamber surrounding a collapsible pump operable by the foot of the wearer for directing compressed air into the support chamber and varying the firmness of the chamber. The support chamber is of a preformed three-dimensional configuration of sufficient rigidity to provide stable support to the foot prior to receiving compressed air from the pump.

7 Claims, 5 Drawing Sheets

SELF-INFLATABLE AIR CUSHION FOR SHOES

CROSS REFERENCE TO RELATED APPLICATION

This application is a continuation-in-part of application Ser. No. 09/388,540, filed on Sep. 2, 1999 now abandoned.

BACKGROUND OF THE INVENTION

The present invention relates to a self-inflatable air cushion for use in shoes, and more particularly to such an air cushion which includes a pump in the form of a collapsible plenum chamber, a support chamber surrounding the pump, and a valve connected between the pump and the support chamber for permitting air to be driven from the pump into the support chamber by compressing the pump with the foot of the user.

A conventional air cushion of this type is generally comprised of a collapsible three-dimensional body defining a plurality of air cells and a plurality of passages connecting the air cells. An air valve is also connected to the passages and disposed outside the sole of the shoe. When the air cushion is to be inflated, an air pump is attached to the air valve and operated to pump air into the air cells. If the inside pressure of the air cushion is excessively high, it cannot be regulated. Moreover, known cushions of this type may also include a pump which is surrounded by a support chamber that is also inflated by the pump. However, this known construction has a distinct disadvantage in that the chamber surrounding the pump is a of a two-dimensional configuration until it has been inflated by the pump. Accordingly, the chamber is always softer than the pump until inflation has been realized. Conventional cushions of this type are incapable of providing stable support for the foot of the user until the cushion has been sufficiently inflated with air.

SUMMARY OF THE INVENTION

It is an object of the present invention to provide a self-inflatable air cushion which comprises a pump in the form of a collapsible plenum chamber having an air hole, a support chamber surrounding the pump, an air passage providing communication between the support chamber and the pump, and an one-way valve disposed in the air passage for permitting air to pass from the pump to the support chamber. When the pump is compressed by the foot of the user, air is forced out of the pump through the one-way valve and into the support chamber. When the foot is released, outside air is drawn into the pump through the air hole. In this way, the firmness of the support chamber may be adjusted. The support chamber is formed from an appropriate material, such as a polymer plastic, which permits it to maintain a preformed three-dimensional structure having sufficient rigidity to provide support for the foot of the user before it has received compressed air from the pump.

According to another object of the invention, a relief valve or pressure regulating chamber is provided to regulate the inside pressure of the support chamber to a desired level.

A still further object of the present invention includes providing a pressure accumulation chamber which has one end connected to the pump through an one-way valve for permitting air to flow from the pump to the pressure accumulation chamber, and an opposite end connected to the support chamber through an one-way valve for permitting air to flow from the pressure accumulation chamber to the support chamber. When the pump is compressed, compressed air is driven from the pump chamber into the pressure accumulation chamber. Since the support chamber is simultaneously subjected to an external pressure, the compressed air pressure of the pressure accumulation chamber is prevented from passing to the support chamber. When the external pressure is released from the support chamber, the compressed air of the pressure accumulation chamber is permitted to pass to the interior of the support chamber.

DETAILED DESCRIPTION OF THE PREFERRED EMBODIMENTS

Figure 1:
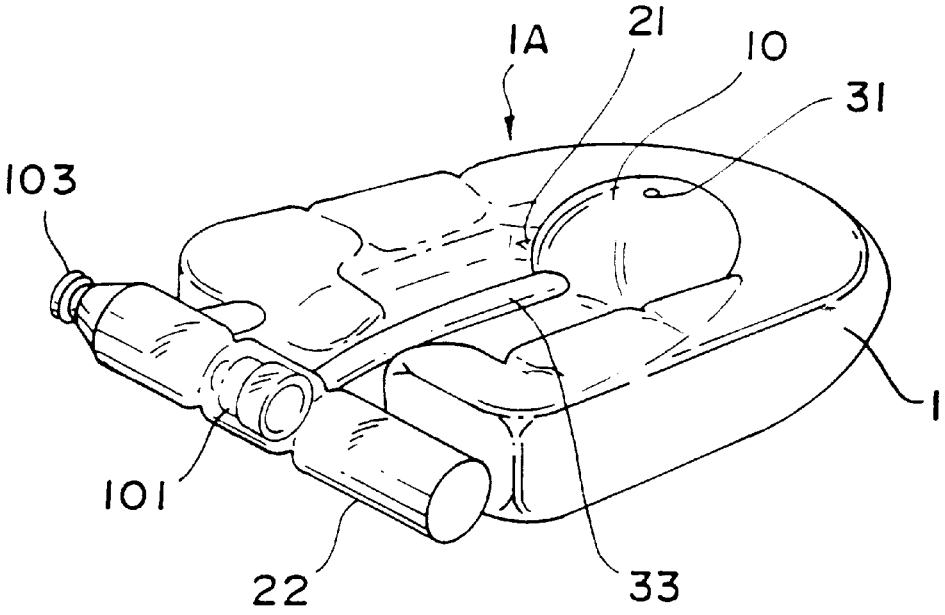
FIG. 1 is a perspective view of a self-inflatable air cushion according to a first embodiment of the present invention

Referring to FIG. 1, a self-inflatable air cushion 1A is shown comprising a support chamber 1, an open space 21 surrounded by support chamber 1, a plenum chamber in the form of a pump 10 disposed in open space 21 and provided with an air hole 31 at a top side thereof, an air cylinder 22 having a rear end disposed in communication with the support chamber 1, a tube 33 forming a passage connecting the pump 10 and air cylinder 22, an one-way valve 101 mounted in the air cylinder 22 for permitting air to pass from the pump 10 through the air cylinder 22 to the interior of the support chamber 1, and a relief valve 103 mounted in a front end of air cylinder 22 for releasing compressed air to the atmosphere.

Support chamber 1 and pump 10 collectively form a cushion system having a central portion defined by pump 10 and an outside portion defined by support chamber 1. Pump 10 functions as an air pump which is actuated by the foot of the user and receives airthrough air hole 31, the air being compressed by the foot of the user and is directed through tube 33, air cylinder 22 and into support chamber 1.

Pump 10 is formed from a material, such as a plastic polymer, which is relatively soft and has a flexible quality to permit it to resume its original shape when pressure from the foot of the user is released therefrom. By contrast, support chamber 1 is formed from a more rigid material, preferably selected from a plastic polymer, which permits surround chamber to maintain a preformed three-dimensional structure before compressed air is pumped into the interior thereof. The amount of compressed air pumped into support chamber 1 by the user determines the degree of firmness desired. Since support chamber 1 is formed of a more rigid material, it maintains itself as a constant three-dimensional structure and, in this manner, always provides stable support for the foot of the user prior to the introduction of compressed air therein. Thus, the cushion system includes a center portion defined by pump 10 that is always softer than a rigid outside portion defined by support chamber 1, whether or not compressed air is introduced into support chamber 1 by pump 10.

Figure 2:
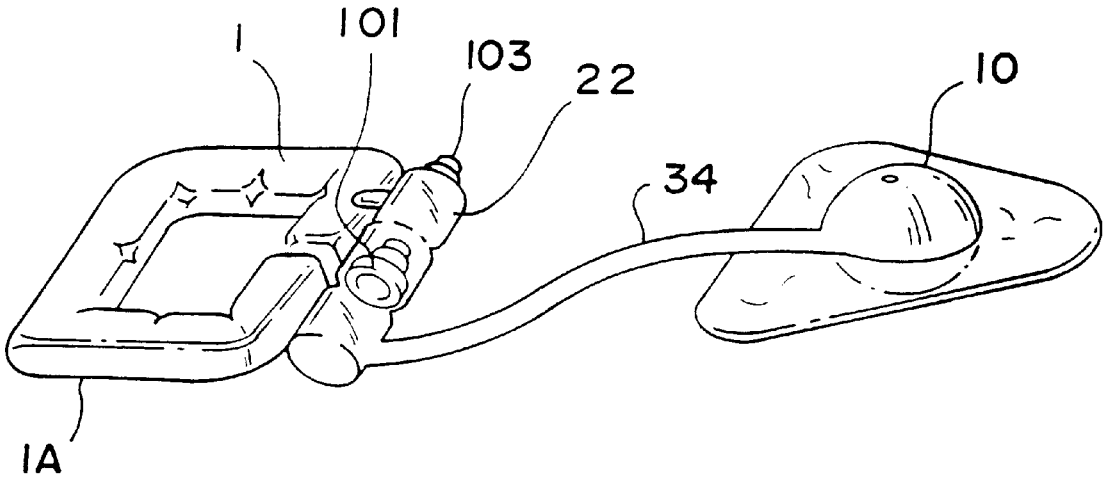
FIG. 2 is a perspective view of a self-inflatable air cushion according to a second embodiment of the present invention.

FIG. 2 shows an alternate form of the present invention. According to this form, the air cushion comprises a support chamber 1, an air cylinder 22 connected to support chamber 1 at one side thereof, a plenum chamber in the form of a pump 10 spaced from the air cylinder 22 at a side opposite to support chamber 1, and a tube 34 forming an air passage connecting air cylinder 22 and pump 10. An one-way valve 101 is mounted in air cylinder 22 for permitting air to be delivered from the pump 10 to support chamber 1, and a relief valve 103 is mounted at a front end of air cylinder 22 for releasing compressed air to the atmosphere.

Figure 3:
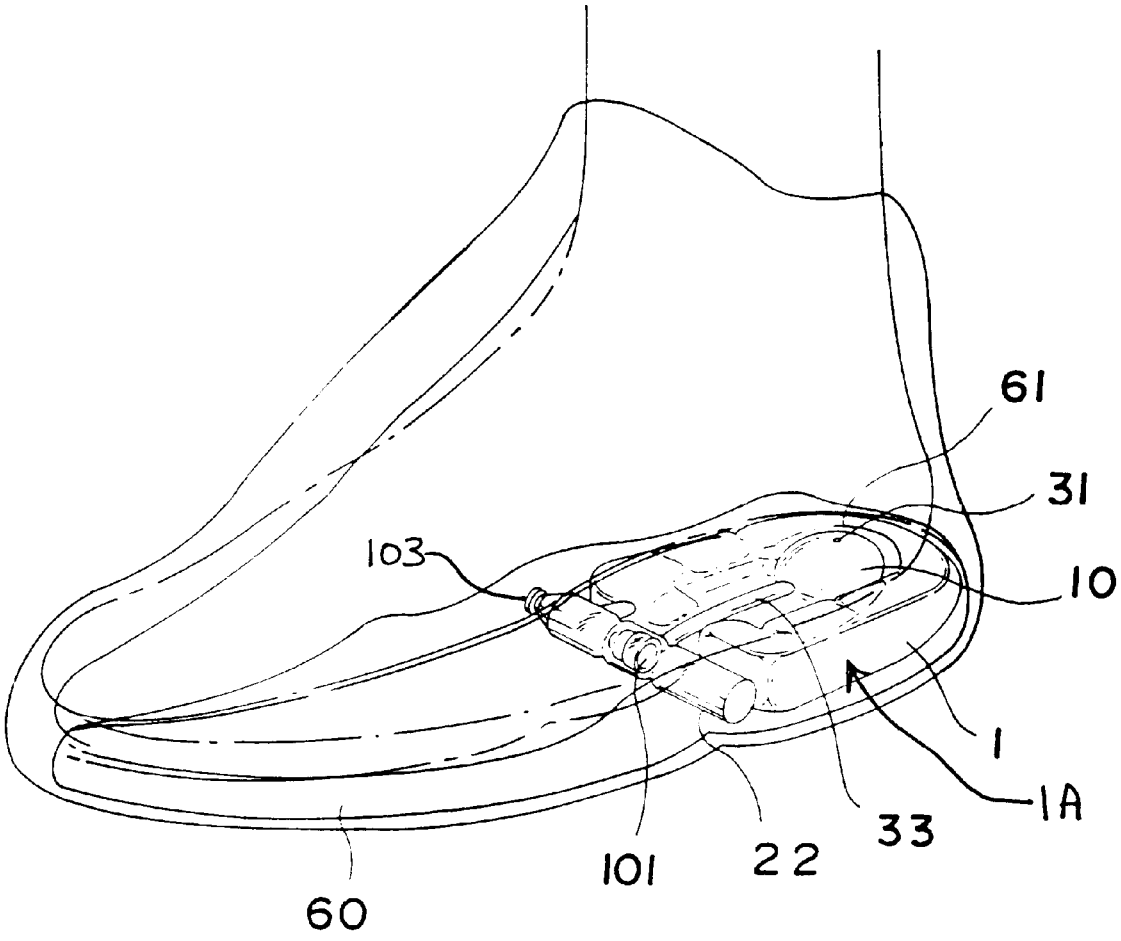
FIG. 3 is a perspective view of the first embodiment, showing the self-inflatable air cushion mounted in an insole of a shoe and operated by the foot of a user.

Referring to FIG. 3, air cushion 1A is shown mounted inside a shoe with pump 10 projecting out of a top hole 61 of an insole 6 at the heel area of the shoe. When the foot of the user compresses pump 10, air inside pump 10 is pressurized and forced through tube 33, air cylinder 22 and into support chamber 1. When the foot of the user is lifted away from pump 10, external air is immediately drawn into pump 10 through air hole 31 due to an air pressure difference between the pressure with pump 10 and the exterior atmospheric pressure. If the user continuously compresses pump 10, support chamber 1 will eventually be filled with compressed air to a saturated status. When support chamber 1 is fully filled with compressed air, support chamber 1 functions as a surrounding support structure around pump 10 against outside pressure. The user may adjust the pressure of compressed air within support chamber 1 to a desired level by operating relief valve 103.

Figure 4:
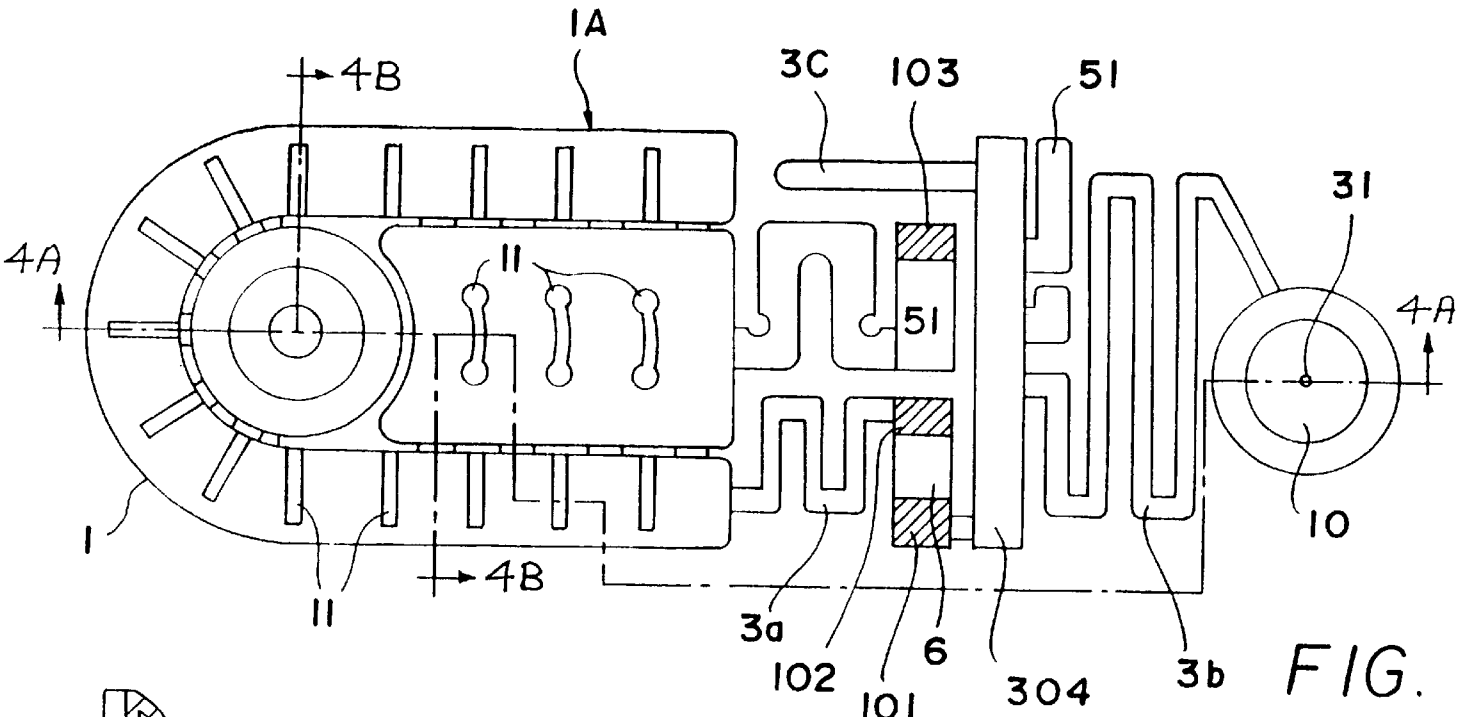
FIG. 4 is a top plain view showing a third embodiment of the present invention.
Figure 4B:
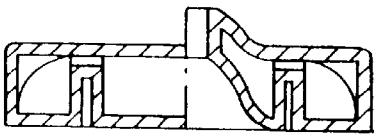
FIG. 4B is a sectional view taken along the line 4B—4B of FIG. 4.
Figure 4A:
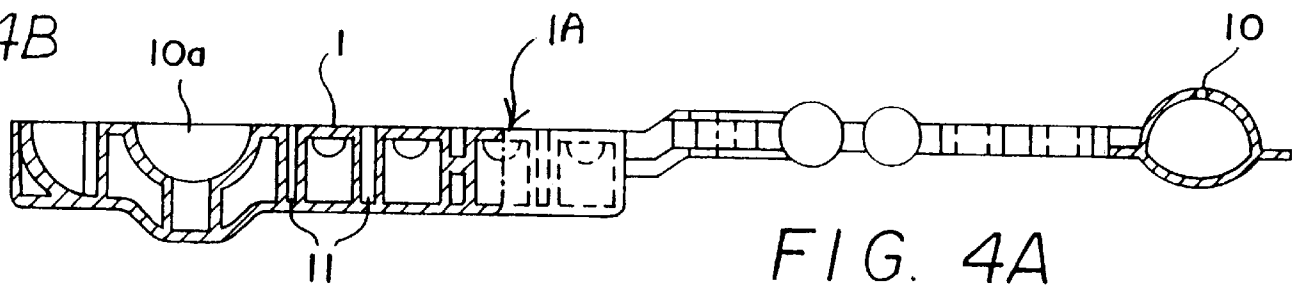
FIG. 4A is a sectional view taken along the line 4A—4A of FIG. 4.

Referring to FIGS. 4, 4A and 4B, outside air passes from the air hole 31 into the pump 10. When the foot of the user applies compressive pressure to pump 10, air hole 31 is closed by the foot of the user and air within the interior of pump 10 is compressed by the foot of the user and pressurized to flow through an air passage 3*b* to a pressure regulating chamber 304 and then through a first one-way valve 101 to a pressure accumulation chamber 6. The pressure accumulation chamber 6 is disposed in a position in which it bears no pressure when support chamber 1 or pump 10 receives compressive pressure from the foot of the user. Therefore, compressed air is allowed to be forced out of pump 10 into the pressure accumulation chamber 6 and thereafter through a second one-way valve 102 into support chamber 1 through an air passage 3*a*.

Figure 4C:
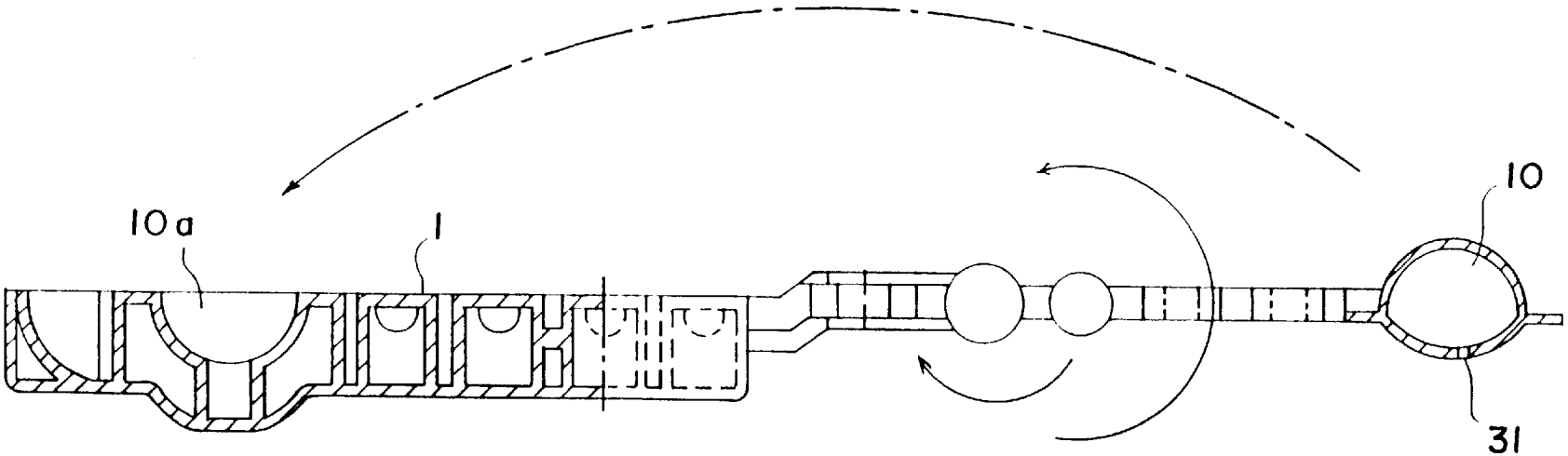
FIG. 4C is a sectional view showing the turning direction of the plenum chamber or pump of the third embodiment shown in FIG. 4.
Figure 4D:
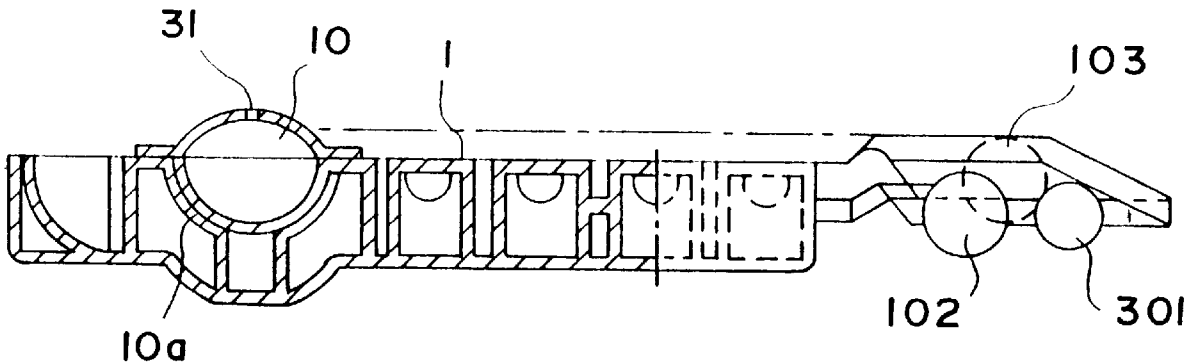
FIG. 4D is a sectional view showing the pump of the third embodiment disposed in the top recess of a corresponding support chamber.

Referring to FIGS. 4C and 4D, pump 10 may be turned backwards through about 180° and positioned within a top recess 10*a* of support chamber 1 with its air hole 31 facing upwardly.

Figure 5:
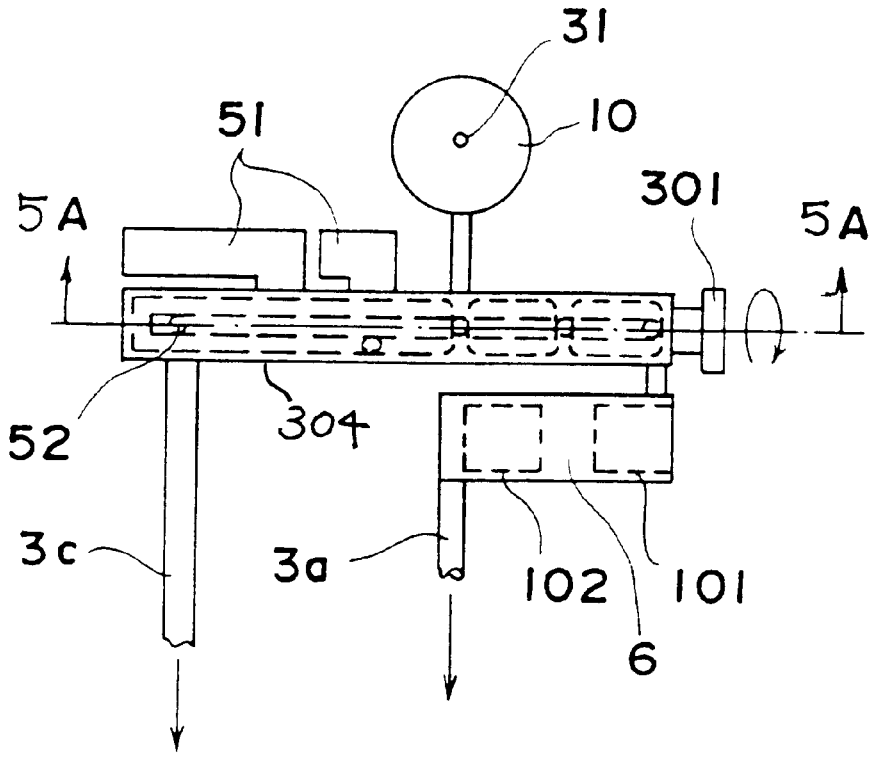
FIG. 5 is a sectional view of a fourth embodiment of the present invention, showing the installation of the pressure regulating rod in the pressure regulating chamber.
Figure 5A:
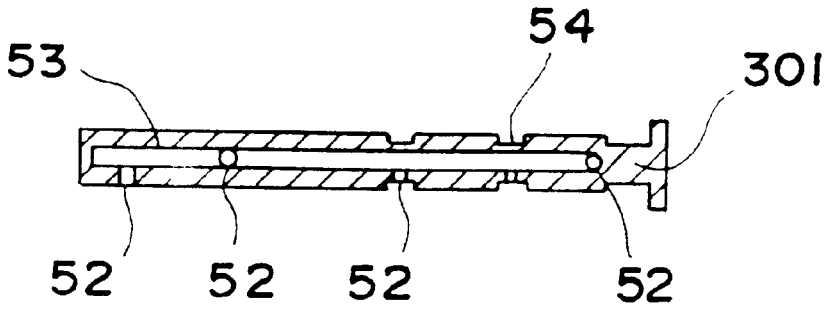
FIG. 5A is a sectional view taken along the line 5A—5A of FIG. 5.

Referring to FIGS. 5 and 5A, a pressure regulating rod 301 is mounted in pressure regulating chamber 304. Pressure regulating rod 301 is a hollow rod having a longitudinal center passageway 53, a plurality of recessed holes 54, and a plurality of radial through holes 52 in communication with center passageway 53. Recessed holes 54 and through holes 52 are arranged in correspondence with a plurality of distribution channels 51, a first one-way valve 101, a second one-way relief valve 102 and air passage 3*a*. The pressure in pressure accumulation chamber 6 and support chamber 1 may be regulated by rotating pressure regulating rod 301. When through holes 52 are moved away from communication with air passage 3*a*, compressed air is prohibited from passing from pump 10 to the support chamber 1 through air passage 3*a*. When air passage 3*a*, through holes 52 and distribution chambers 51 are disposed in communication with one another through longitudinal center passageway 53, pressurized air is permitted to pass into pressure accumulation chamber 6 subject to the volume of distribution chambers 51.

As an example, assume the inside volume of pump 10=A, the inside volume of the distribution chambers 51=B, the inside volume of pump 10 when collapsed=C, thus P1V1*P2V2=n. The pressure of pump 10 after compression is Pb=PaA/B+C. Therefore, an increase in the inside volume B of distribution chambers 51 will result in a corresponding decrease in the air pressure Pb of pressure accumulation chamber 6.

When through holes 52 and pump 10 are disposed in communication with an air passage 3*c*, air is permitted to be compressed out of pump 10 through air passage 3*c* to another air circulation area. This permits air cushion 1A to improve the ventilation of the shoe.

It is to be understood that the preferred embodiments of the invention described herein are for purposes of illustration only and that they are not intended to limit the scope of the disclosed invention which is set forth in the appended claims.

What is claimed is:

1. A self-inflatable air cushion for providing foot support in a shoe, the air cushion comprising:

a) a hollow support chamber being formed from a first material and having a preformed three-dimensional structure, the support chamber defining an open space and forming an assembly therewith, and the support chamber being adapted for receiving compressed air from a pump;

b) a hollow pump disposed within the open space, the pump being formed from a second material that is less rigid than the first material and is collapsible by the foot of a user for compressing air within the pump;

c) a passage connecting the support chamber to the pump for adjusting the firmness of the support chamber, and a one-way valve in the passage for limiting flow of compressed air in one direction from the pump to the support chamber; and d) the first material forming the support chamber having a sufficient rigidity to maintain the support chamber as a preformed three-dimensional structure and providing stable support to the foot of the wearer prior to the support chamber receiving compressed air from the pump.

2. The air cushion of claim 1, wherein the pump is surrounded by the support chamber.

3. The air cushion of claim 1, wherein the pump includes an air hole at a top side thereof, the air hole defining an air inlet valve for receiving ambient air to be compressed by the foot of the user.

4. The air cushion of claim 1, further including a relief valve disposed in the passage for releasing compressed air from the support chamber.

5. The air cushion of claim 1, wherein the passage connecting the support chamber with the pump includes a tube which may be folded to dispose the pump within the open space.

6. The air cushion of claim 1, wherein the pump, passage and support chamber are integrally formed as a whole unit.

7. The air cushion of claim 1, further including a combination of the air cushion assembled with a sole of a shoe.

* * * * *